United States Patent [19]

Nakayama et al.

[11] 4,146,090

[45] Mar. 27, 1979

[54] PLATE TYPE HEAT EXCHANGER

[75] Inventors: Yoshihiko Nakayama, Hirakata; Norio Komano, Nara, both of Japan

[73] Assignee: Hisaka Works Ltd., Osaka, Japan

[21] Appl. No.: 781,969

[22] Filed: Mar. 28, 1977

[51] Int. Cl.[2] ..... F28F 3/10

[52] U.S. Cl. ..... 165/166; 165/167

[58] Field of Search ..... 165/166, 167

[56] References Cited

U.S. PATENT DOCUMENTS

| | | | |
|---|---|---|---|
| 3,760,873 | 9/1973 | Wright | 165/166 |
| 3,792,730 | 2/1974 | Andersson | 165/167 |

*Primary Examiner*—Albert W. Davis, Jr.

*Attorney, Agent, or Firm*—Hall & Houghton

[57] ABSTRACT

A plate type heat exchanger having heat exchange plates wherein in order to increase the support strength of the packing groove periphery to prevent flexure while providing reliable sealing, the lateral wall defining the peripheral edge of a packing groove is shaped in such a manner that its upper surface is capable of abutting against the bottom surfaces of distributing grooves while in a double seal region the width of a liquid passage groove in a plate having no packing mounted therein is smaller than that of a packing groove in a plate having a packing mounted therein, so that the bottom surface of the liquid passage groove and the upper surface of the lateral wall abut against the upper surface of the packing and bottom surface of the packing groove.

3 Claims, 9 Drawing Figures

PLATE TYPE HEAT EXCHANGER

BACKGROUND OF THE INVENTION

1. Field of the Invention

The present invention relates to a plate type heat exchanger and more particularly it relates to a plate type heat exchanger having a plurality of plates put together so as to define clearances therebetween through which two fluids pass for heat exchange.

2. Description of the Prior Art

A conventional plate type heat exchanger is constructed generally in the manner shown in FIGS. 1 through 3, wherein heat exchange plates are designated at 2 and 3 and there are provided packings 1*a*, 1*a* each extending around the outer periphery of such plate so as to define the peripheral edge of a fluid channel when said plates are put together. Each plate 2, 3 has four fluid passage holes at the four corners. There are distributing surfaces 22 and 32 between the fluid passage holes 21, 31 and heat exchange surfaces 23, 33. Designated at 2*a* and 3*a* are packing grooves extending around the peripheries of the passage holes 21 and 31, and a packing 1*b* is fitted in such groove in every other plate. Of the two fluids m and n on the heat transmitting and heat transmitted sides, one fluid, for example, m is allowed to flow into alternate fluid channels defined between the plates.

Since each packing 1*b* is disposed in every other spacing defined between the plates put together and clamped, the packing mount periphery lacks strength and tends to flex. As a countermeasure, it has previously been proposed to provide the distributing surface 22 of the plate 2 on the packing mount side with an intermediate step 2*g*, as shown in FIG. 4, and reduce the distance from a point of contact 4 between its bottom and an adjacent plate 3 to the packing groove. With such construction, however, when the plates are clamped although the strength of the plate 2 on the packing mount side is increased, the strength of the plate 3 on which such packing is not mounted remains insufficient. Rather, in the plate 3, the packing groove 3 is pushed by the packing 1*b* of the adjacent plate to flex as shown in phantom line, such flexure extending to the distributing surface 32, resulting in the latter flexing in the direction opposite to that of the flexure of the packing groove 3*a* (as ascertained by experimental results).

The packing 1*b* described above is disposed in the fluid passage hole region in the plate clearance, i.e., it is disposed between the passage hole and the distributing surface and serves to define the fluid passageway and strengthen the support for the plate clearance, but usually a double seal construction is employed as a seal construction for the peripheries of the fluid entrance and exit. For example, in a conventional embodiment shown in FIGS. 1 through 3, there is provided a double seal construction comprising said packing 1*b* disposed between the passage hole 21 and the distributing surface 22 and additionally a packing 1*c* disposed between the distributing surface 22 and heat exchange surface 23.

Conventionally, in such double seal construction, the packing groove width is the same for the packing mount side and no-packing mount side and hence there has been the danger that upon clamping of the plates the bottom surface of the packing groove 3*j* on the no-packing mount side is pressed by the packing 1*c* of the adjacent 2 to deform as shown in phantom line in FIG. 3. Such deformation not only greatly detracts from the sealing quality but also decreases the reinforcing property of the plate. As a countermeasure, as shown in FIG. 5, it is known to put the plate together with a reinforcing strip 5 received in the packing groove 3*j* on the no-packing mount side. The presence of such strip 5 improves the sealing quality but has the following disadvantages: The single strip adds to the number of assembling steps and hence to the cost. Further, the attachment of the strip 5 requires a thermal operation such as welding, so that the corrosion resistance of the welded portion is decreased. The presence of the strip 5 increases the resistance to the flow of fluid and can cause contamination.

SUMMARY OF THE INVENTION

An object of the invention is to eliminate the disadvantages of the prior art described above and provide a plate type heat exchanger consturction designed to increase the strength of the packing groove periphery to prevent flexure while providing reliable sealing.

According to a first embodiment of the invention, the distributing surface of the plate on the no-packing mount side is provided with distributing grooves having the same depth as the packing groove and equispaced in a direction perpendicular to the packing groove and the boundary between the distributing grooves and the packing groove is provided with a continuous projecting lateral wall defining the outer peripheral edge of the packing groove, the bottom of such distributing groove abutting against the upper surface of the lateral wall of the packing groove in the adjacent plate. On the other hand, in the packing-mounted plate, the continuous projecting lateral wall defining the outer peripheral edge of the packing groove is provided with recesses having the same depth as the packing groove and equispaced in the direction of the packing groove, the bottoms of such recesses abutting against the upper surface of the lateral wall of the packing groove in the adjacent plate.

According to another embodiment of the invention, in the double seal region, the packing groove in the plate having no packing mounted thereon has a smaller width than that of the packing groove in the packing-mounted plate and functions as a liquid passage groove.

Other novel and characteristic features of the present invention will be fully described with reference to the accompanying drawings illustrating embodiments thereof.

BRIEF DESCRIPTION OF THE DRAWINGS

FIGS. 1 and 2 show the general construction of plate type heat exchangers, wherein FIG. 1 is a perspective view of a plurality of plates to be put together and FIG. 2 is an enlarged perspective view of the principal portion of FIG. 1;

FIGS. 3 through 5 show a conventional example concerning improvements in a plate type heat exchanger, wherein FIG. 3 is a cross-sectional view of the principal portion showing plates put together, FIG. 4 is a partial view showing an example of conventional improvement concerning the portion I in FIG. 3, and FIG. 5 is a partial view concerning the portion II; and FIGS. 6 through 9 show a plate type heat exchanger construction according to the present invention, wherein FIG. 6 is a partial view showing a first concrete example according to improvements in the portion I in FIG. 3, FIG. 7 is a partial front view of the plate taken along the line III—III of FIG. 6 with the packing removed, FIG. 8 is a partial front view of the plate taken along the line IV—IV of FIG. 6, and FIG. 9 is a partial view showing a second concrete example according to improvements in the portion II in FIG. 3.

DESCRIPTION OF THE PREFERRED EMBODIMENTS

A first embodiment of the present invention will be described with reference to FIGS. 6 through 8.

Figure 6:
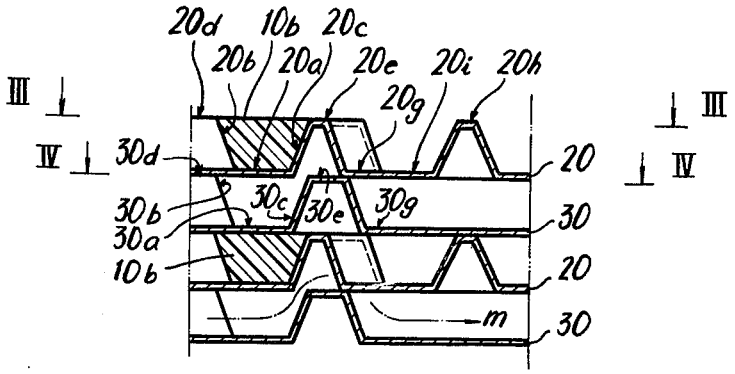

In FIG. 6, packings are designated at 10*b*, and 20 designates plates on which the packings 10*b* are mounted while 30 designates plates on which such packings are not mounted.

Figure 3:
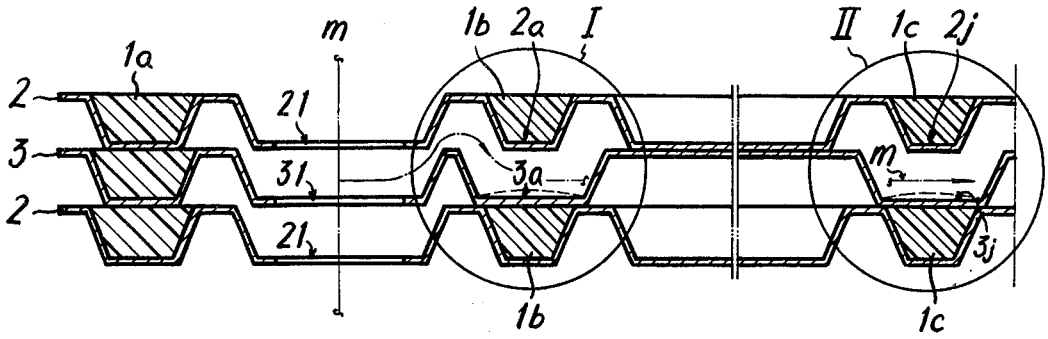
Fig. 3 PRIOR ART
Figure 4:
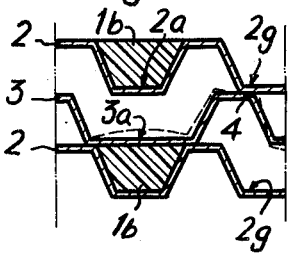
Fig. 4 PRIOR ART
Figure 5:
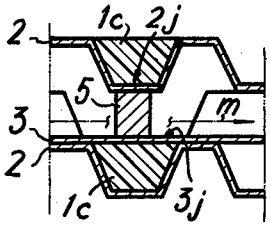
Fig. 5 PRIOR ART

The plates 20 and 30 have fluid passage holes 21 and 31 shown in the left-hand portion of FIG. 3, such fluid passage holes being omitted in FIG. 6. Packing grooves 20*a* and 30*a* are provided between said passage holes and distributing surfaces 22 and 32, respectively.

Figure 7:
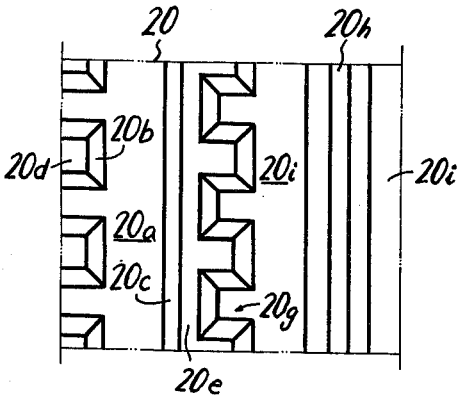

In the heat exchange plates 20 having the packing 10*b* mounted thereon, as shown in FIG. 7, the lateral wall 20*b* of the packing groove 20*a* on the passage hole side is discontinuous in the form of a number of projections while the lateral wall 20*c* thereof on the distributing surface 22 side is in the form of a continuous projection. The lateral wall 20*c* is formed with recesses 20*g* disposed as close as possible to the packing groove 20*a* and having the same depth as the packing groove 20*a* and equispaced in the direction of the packing groove. Further, the distributing surface 22 is formed with a plurality of ridges 20*h* (only one such ridge is illustrated) extending parallel with said continuous lateral wall 20*c*, and a distributing groove 20*i* is defined between adjacent ridges 20*h*. Designated at 20*d* is the upper surface of said lateral wall 20*b*.

Figure 8:
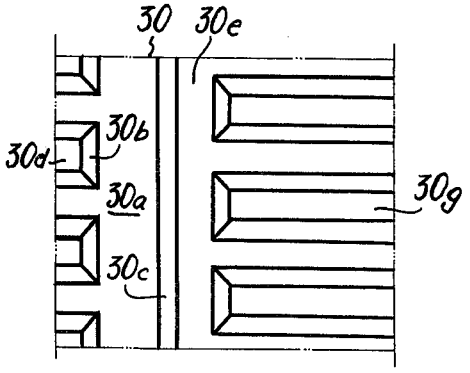

On the other hand, in the heat exchange plates 30 having no said packing mounted thereon, as shown in FIG. 8, the lateral wall 30*b* of the packing groove 30*a* on the passage hole side is discontinuous in the form of projections equispaced along the packing groove 30*a* while the lateral wall 30*c* thereof on the distributing surface 32 side is in the form of a continuous ridge. The distributing surface 32 is formed with equispaced distributing grooves 30*g* extending in a direction perpendicular to the packing groove 30*a*. The distributing grooves 30*g* have the same depth as the packing groove 30*a*, and the ends of the distributing grooves 30*g* on the packing groove 30*a* side are disposed as close as possible to the packing groove 30*a* and the groove bottom ends abut against the upper surface 20*e* of the lateral wall 20*c* of the packing groove 20*a* in the adjacent plate 20. Designated at 30*d* is the upper surface of said lateral wall 30*b*.

FIG. 6 shows the plates put together and clamped. One fluid, for example, m passing through the left-hand passage hole (not shown) passes through the region where there is no packing 10*b*, and it flows to the distributing surface, as shown in chain lines. In this connection, since the packing 10*b* is mounted on every other plate, one fluid m or n flows through every other channel defined between ajacent plates.

The influences of the plate clamping force on the peripheries of the packing grooves 20*a* will now be described with reference to FIG. 6.

The packing groove 20*a* tends to flex downward as viewed in FIG. 6. More particularly, the recesses 20*g* are in contact with the upper surface 30*e* of the lateral wall of the lower adjacent plate 30, so that the packing groove 20*a* tends to flex downward around the points of contact while the distributing surface 22 tends to flex upward around said points of contact. However, since the upper surface 20*e* of the lateral wall of the plate 20 is in contact with the bottom surfaces of the distributing grooves 30*g* of the upper adjacent plate 30, upward flexure of the distributing surface 22 is prevented. As a result, downward flexure of the packing groove 20*a* is also prevented.

In this case, since the recesses 20*g* of the plate 20*a* are in contact with the ridge 30*e* of the adjacent plate 30 at positions closer to the packing groove 20*a*, the support strength against downward flexure of the packing groove 20*a* is high.

On the other hand, the packing groove 30*a* in the plate 30 has the plate clamping force acting thereon through the packing 10*b* and tends to flex upward while the distributing surface tends to flex downward.

In this case, the upper surface 30*e* of the lateral wall is in contact with the bottom surfaces of the recesses 20*g* of the plate 20 while the distributing grooves 30*g* are in contact with the upper surface 20*e* of the lateral wall of the plate 20, so that downward flexure of the distributing surface 32 is prevented. As a result, the flexing action of the packing 30*a* tending to flex upward around the points of contact between the recesses 20*g* and the ridge 30*e* is minimized and flexure thereof is prevented. That is, contact between the distributing grooves 30*g* and the upper surface 20*e* of the lateral wall prevents flexure of the periphery of the packing groove 30*a*.

Thus, the support strength of the periphery of the packing groove of the packing-mounted plate cooperates with the support strength of the periphery of the packing groove of the no-packing mounted plate to increase each other, whereby prevention of packing groove peripheries is achieved.

A second embodiment of the present invention concerning a double seal construction will now be described.

Figure 9:
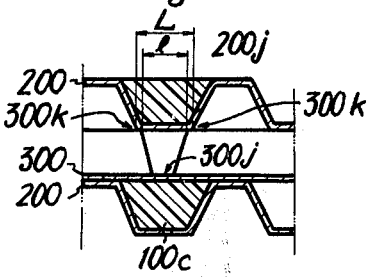

In FIG. 9, packings are designated at 100*c*. Designated at 200 are plates having the packings 100*c* mounted thereon while 300 designates a plate having no such packing mounted thereon. In said plates 200, the packing 100*c* is fitted in a packing groove 200*j*. In the plate 300 having no such packing mounted thereon, a portion 300*j* corresponding to the packing groove 200*j* in the adjacent plate 200 functions as a liquid passage hole. Thus, the essence of the second embodiment lies in the fact that the width of the liquid passage groove 300*j* of the no-packing-mounted plate is made smaller than that of the packing groove 200*j* of the packing-mounted plate. To be exact, the top width l of the liquid passage groove 300*j* is made smaller than the bottom width L of the packing groove 200*j*.

Figure 1:
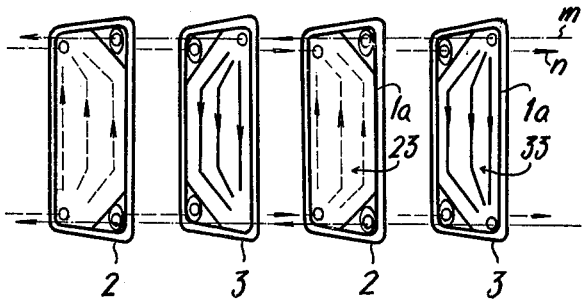
Fig.1 PRIOR ART
Figure 2:
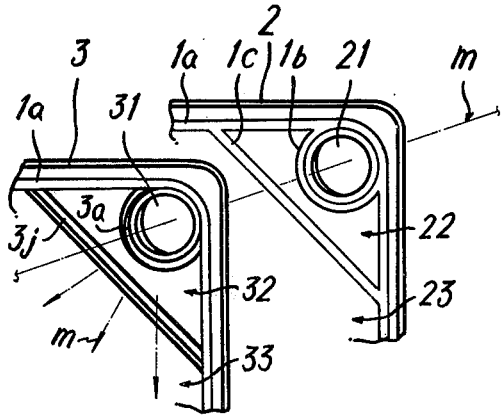
Fig.2 PRIOR ART

According to the dimensional relation described above, when the plates 200 and 300 are put together, the upper surface of the lateral wall of the liquid passage groove 300*j* abuts against the bottom surface of the packing groove 200*j* of the adjacent plate 200 and the bottom of the liquid passage groove 300*j* is urged against the upper surface of the packing 100*c*. Thus, the liquid passage groove 300*j* provides the same reinforcing effect as the strip 5 in the conventional arrangement and moreover it does not interfere with the flow of liquid passing therethrough. In addition, it has been found that even if the width of the liquid passage groove 300*j* was narrowed, the resistance to the flow of fluid did not much differ from that of the conventional arrangement shown in FIG. 1. In other words, the conventional width was greater than was necessary.

As described above, according to the second embodiment of the invention, the liquid passage groove in the double seal region is held between the packing groove and packing in the adjacent plates and hence reliable reinforcement and improved sealing are obtained in the double seal region. Further, the number of assembling steps is reduced since it is only necessary to put the plates together without using separate members such as strips. Since there is no need for thermal operation, troubles such as damage to the plates are minimized.

We claim:

1. In a plate type heat exchanger having at least a pair of heat exchange plates, each of said plates having a fluid passage hole for receiving a heat exchanging fluid therein and a fluid distributing surface over which said heat exchanging fluid may flow, each of said plates having a packing groove extending between said passage hole and said distributing surfaces, and a packing member fitted into the packing groove of one of said plates with the packing groove of the other plate being free of a packing member thereby permitting two fluids to flow into alternate plate clearance over the distributing surface thereof, the improvement comprising the said heat exchange plate having the packing member positioned in the packing groove therein having the distributing surface thereof provided with at least one fluid distributing groove laterally spaced from and in parallel relationship to said packing groove, a continuous ridge portion in the distributing surface thereof and extending in parallel relationship to and between said packing groove and said fluid distributing groove, said continuous ridge portion along one side defining a lateral wall of said packing groove with the opposite side thereof having a plurality of longitudinally spaced projections extending laterally outwardly from said ridge portion in the direction of said fluid distributing groove, the heat exchanger plate in which the packing groove thereof contains no packing member having its fluid distribution surface provided with a plurality of longitudinally spaced, fluid distributing grooves extending in laterally spaced and transverse relationship to the packing groove, and a continuous ridge portion in the distributing surface thereof, said ridge portion extending between said packing groove and said plurality of fluid distributing grooves, said ridge portion being in parallel relationship to said packing groove and in transverse relationship to said fluid distributing grooves, said ridge portion defining along one side a lateral wall of said packing groove, said pair of heat exchange plates, when in assembled relationship with one another, having the upper surface of the projections of the longitudinally extending ridge portion of the plate having the packing member therein abutting against the bottom surface of the distributing grooves of said plate having no packing member therein.

2. A plate type heat exchanger in accordance with claim 1, wherein the end of the bottom surface of the fluid distributing groove on the plate having the packing member therein abutting on the upper surface of the continuous ridge portion on the plate having no packing member therein.

3. A plate type heat exchanger in accordance with claim 1, wherein each of said plates has a discontinuous ridge portion in the form of a plurality of longitudinally spaced ridge elements adjacent each packing groove on the side opposite said continuous ridge portion, said ridge elements of said discontinuous ridge portion along one side defining a lateral wall of said packing groove.

* * * * *